US011739992B2

(12) United States Patent
Bahman et al.

(10) Patent No.: US 11,739,992 B2
(45) Date of Patent: Aug. 29, 2023

(54) AIR CONDITIONING SYSTEM WITH SOLAR-POWERED SUBCOOLING SYSTEM

(71) Applicant: KUWAIT UNIVERSITY, Safat (KW)

(72) Inventors: Ammar M. Bahman, Safat (KW); Osama Mohamed Ibrahim, Safat (KW); Sara Barghash, Safat (KW)

(73) Assignee: KUWAIT UNIVERSITY, Safat (KW)

( * ) Notice: Subject to any disclaimer, the term of this patent is extended or adjusted under 35 U.S.C. 154(b) by 260 days.

(21) Appl. No.: 17/191,638

(22) Filed: Mar. 3, 2021

(65) Prior Publication Data

US 2022/0282893 A1 Sep. 8, 2022

(51) Int. Cl.
*F25B 27/00* (2006.01)
*F25B 5/02* (2006.01)
(Continued)

(52) U.S. Cl.
CPC ..... *F25B 27/005* (2013.01); *F25B 5/02* (2013.01); *F25B 40/02* (2013.01); *F24F 2005/0064* (2013.01); *F25B 2600/024* (2013.01)

(58) Field of Classification Search
CPC .. F25B 7/00; F25B 5/02; F25B 27/002; F25B 27/005; F25B 40/00; F25B 40/02; F25B 2600/024; F25B 2005/0064
See application file for complete search history.

(56) References Cited

U.S. PATENT DOCUMENTS 3,783,629 A * 1/1974 Phillips ..... F25B 1/00 62/85
4,926,658 A * 5/1990 Olsen ..... F25B 41/38 137/513.3
(Continued)

FOREIGN PATENT DOCUMENTS

CN 205690576 U 11/2016
CN 208332532 U 1/2019
(Continued)

OTHER PUBLICATIONS

English translation of CN 111964196 A1. (Year: 2020).*
(Continued)

*Primary Examiner* — Miguel A Diaz
(74) *Attorney, Agent, or Firm* — Nath, Goldberg & Meyer; Richard C. Litman

(57) ABSTRACT

The air conditioning system with solar-powered subcooling system includes a main cooling system having an evaporator, a compressor, a condenser, and an expansion valve configured to operate in a conventional vapor compression refrigerant cycle. The subcooling system includes a compressor, a condenser, and an expansion valve, the compressor being powered by at least one rechargeable battery connected to a photovoltaic solar panel. The main system and the subcooling system are linked by a heat exchanger having a primary coil in the main system between the condenser and the expansion valve and a secondary coil in the subcooling system disposed between the expansion valve and the compressor. The main system and the subcooling system may use the same type of refrigerant, or different refrigerant types. The additional cooling provided to the refrigerant in the main system by subcooling increases the efficiency of the air conditioning system.

8 Claims, 12 Drawing Sheets

(51) Int. Cl.
*F25B 40/02* (2006.01)
*F24F 5/00* (2006.01)

(56) References Cited

U.S. PATENT DOCUMENTS 5,742,147 A * 4/1998 Molina ..... F04B 49/06 320/125
6,813,897 B1 * 11/2004 Bash ..... G06F 1/206 307/64
8,652,348 B1 * 2/2014 Shihab ..... C09K 5/045 62/292
11,305,616 B2 * 4/2022 Poolman ..... B60P 3/20
2010/0043475 A1 * 2/2010 Taras ..... F28F 9/0234 62/331
2016/0197534 A1 * 7/2016 Walker ..... F25B 11/02 290/52
2017/0358926 A1 12/2017 Zhuo et al.
2019/0299751 A1 * 10/2019 Poolman ..... B60P 3/20
2020/0041163 A1 * 2/2020 Eslami-Nejad ..... F25B 6/04
2022/0080809 A1 * 3/2022 Mehlan ..... F25B 25/005
2022/0325930 A1 * 10/2022 Day ..... B60H 1/00907

FOREIGN PATENT DOCUMENTS

CN 109386837 A * 2/2019
CN 110410904 A 11/2019
CN 209893578 U 1/2020
CN 210267481 4/2020
CN 111964196 A * 11/2020
CN 114256866 A * 3/2022
EP 3112776 A1 * 1/2017

OTHER PUBLICATIONS

"Model ACDC12C 100% Solar Air Conditioner", Copyright 2010, Hotspot Energy Inc., published at www.hotspotenergy.com/solar-air-conditioner/.

* cited by examiner

AIR CONDITIONING SYSTEM WITH SOLAR-POWERED SUBCOOLING SYSTEM

BACKGROUND

1. Field

The disclosure of the present patent application relates to air conditioning systems, and particularly to an air conditioning system with solar-powered subcooling system.

2. Description of the Related Art

In modern society, air conditioning systems are considered a necessary or desirable feature in both residential and commercial structures. Air conditioning contributes to the comfort of the occupants, and may also be required for the proper functioning of electronic equipment (e.g., in computer rooms) and for the health of persons afflicted with respiratory or allergic impairments. Modern air conditioning systems, particularly central air conditioning systems, frequently use mechanical cooling employing a refrigerant that undergoes a vapor compression cycle with the aid of a compressor that is often powered by electrical power generated using fossil fuels, which make them expensive and which are also believed to contribute to global climate change. In temperate climate zones, these problems may be at least partially alleviated by setting the thermostat for indoor temperature at a higher or more moderate temperature during some portions of the warm season or turning the air conditioning off at cooler times of the day. However, this may not be feasible in tropical and subtropical climates, and moreover, conventional fossil fuel-based air conditioning systems may not operate as efficiently due to the higher outdoor ambient temperatures. Therefore, there is a need for a more efficient air conditioning system that at least partially makes use of greener, more environmentally friendly energy sources.

Thus, an air conditioning system with solar-powered subcooling system solving the aforementioned problems is desired.

SUMMARY

The air conditioning system with solar-powered subcooling system includes a main cooling system having an evaporator, a compressor, a condenser, and an expansion valve configured to operate in a conventional vapor compression refrigerant cycle. The subcooling system includes a compressor, a condenser, and an expansion valve, the compressor being powered by at least one rechargeable battery connected to a photovoltaic solar panel. The main system and the subcooling system are linked by a heat exchanger having a primary coil in the main system between the condenser and the expansion valve and a secondary coil in the subcooling system disposed between the expansion valve and the compressor. The main system and the subcooling system may use the same type of refrigerant, or different refrigerant types. The additional cooling provided to the refrigerant in the main system by subcooling increases the efficiency of the air conditioning system.

These and other features of the present subject matter will become readily apparent upon further review of the following specification.

BRIEF DESCRIPTION OF THE DRAWINGS

Similar reference characters denote corresponding features consistently throughout the attached drawings.

DETAILED DESCRIPTION OF THE PREFERRED EMBODIMENTS

The air conditioning system with solar-powered subcooling system includes a main cooling system having an evaporator, a compressor, a condenser, and an expansion valve configured to operate in a conventional vapor compression refrigerant cycle. The subcooling system includes a compressor, a condenser, and an expansion valve, the compressor being powered by at least one rechargeable battery connected to a photovoltaic solar panel. The main system and the subcooling system are linked by a heat exchanger having a primary coil in the main system between the condenser and the expansion valve and a secondary coil in the subcooling system disposed between the expansion valve and the compressor. The main system and the subcooling system may use the same type of refrigerant, or different refrigerant types. The additional cooling provided to the refrigerant in the main system by subcooling increases the efficiency of the air conditioning system.

The air conditioning system with solar-powered subcooling system is particularly effective for regions having hot climates, such as tropical and subtropical zones. In the following description, the system is modeled for all months in Kuwait using the laws of thermodynamics, with equations being solved by engineering equation solver (EES) software (Klein and Alvarado, 2019). The model is investigated for different subcooling temperatures, working refrigerants, and solar panel areas. Application of the system to other areas having hot climates may be made by suitable modifications to the parameters considered in the following description.

Figure 1:
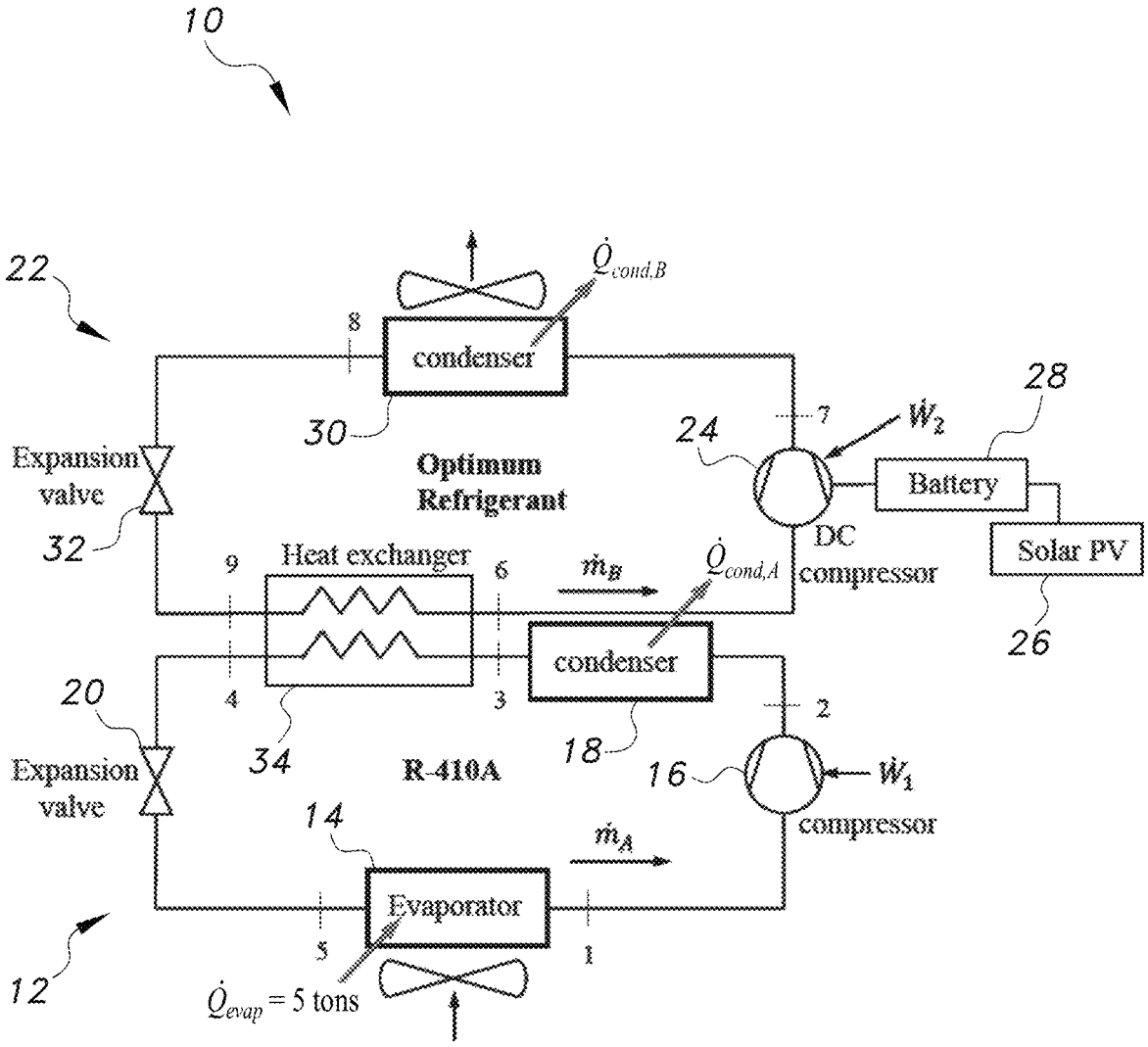
FIG. 1 is a schematic diagram of an air conditioning system with solar-powered subcooling system.

As shown in FIG. 1, the air conditioning system with solar-powered subcooling system, designated generally as 10 in the drawing, includes a main air conditioning system 12 having an evaporator 14, a compressor 16, a condenser 18, and an expansion valve 20. The main air conditioning system 12 was modeled assuming an air conditioning unit having a refrigerant capacity of five tons, where cooling demand varies depending on the time and day of the year calculated using the cooling load temperature deference (CLTD) method for residential air conditioning under Kuwait's weather conditions. The refrigerant used in the main air conditioning system 12 for initial or baseline testing is R-410A, which is a commonly used refrigerant in air conditioning systems in Kuwait. The flow of refrigerant through the main system 12 is through the evaporator 14, then through the compressor 16, then the condenser 18, and through the expansion valve 20, back to the evaporator 14 for the next cycle. The hash marks numbered 1 through 5 in FIG. 1 represent different stages or states in the refrigeration cycle, as discussed in detail with respect to FIG. 2.

As shown in FIG. 1, in order to increase the efficiency of the main system, a subcooling system 22 has been added to further cool the refrigerant in the main system 12, thereby increasing subcooling of the R-410A refrigerant in the main system 12. The subcooling system 22 includes a compressor 24, which may be powered by a solar or photovoltaic panel 26 connected to a rechargeable battery 28; a condenser 30; and an expansion valve 32. The subcooling system 22 is connected to the main air conditioning system 12 by a heat exchanger 34, which is common to both systems 12, 22. One coil of the heat exchanger 34 is disposed in the main air conditioning system 12 between the condenser 18 and the expansion valve 20, while the other coil of the heat exchanger 34 is disposed in the subcooling system 22 between the expansion valve 32 and the compressor 24. The refrigerant in the subcooling system 22 is optimized, as described below, but R-410A is used for the initial or baseline assessment. The flow of refrigerant through the subcooling system 22 is from the compressor 24 to the condenser 30, to the expansion valve 32, through the heat exchanger 34 and back to the compressor 24 to begin the next cycle. The hash marks in FIG. 1 numbered 6 through 9 represent different stages or states in the refrigeration cycle, as discussed in detail with respect to FIG. 2.

Figure 2:
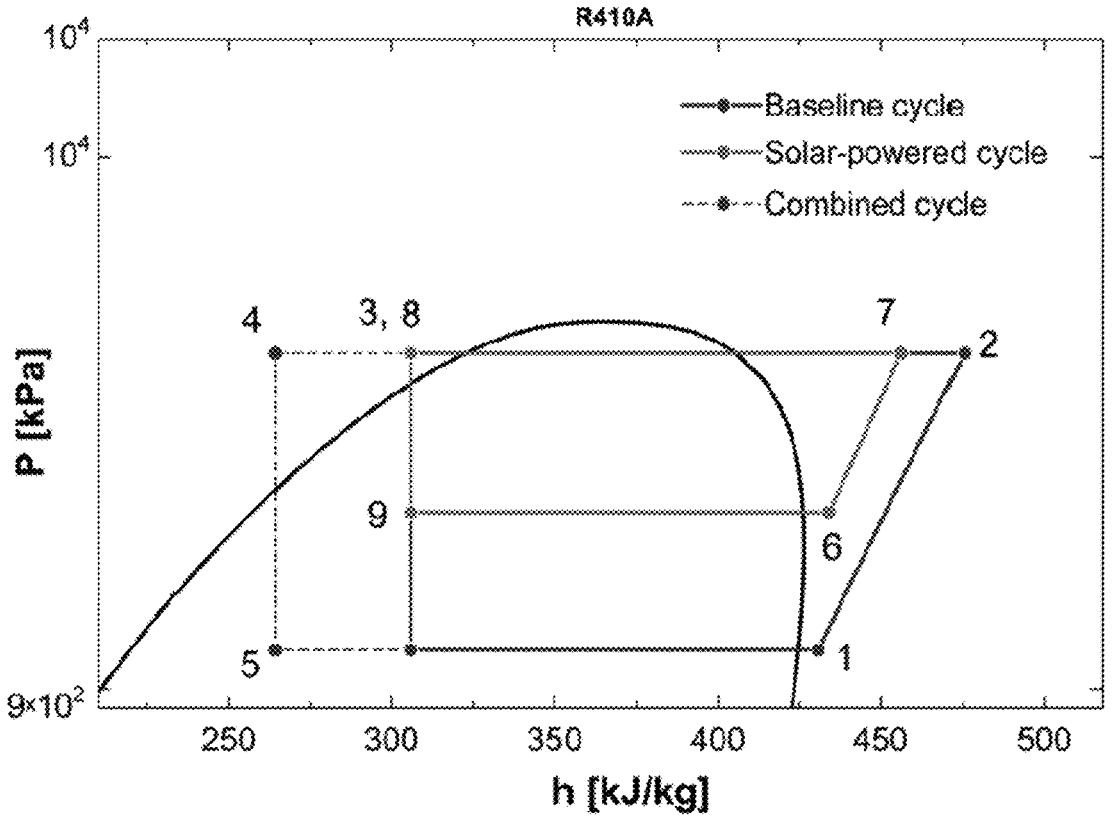
FIG. 2 is a pressure-enthalpy (P-h) diagram of the air conditioning system of FIG. 1 when using R-410A refrigerant in both the main system and the subcooling system.

The P-h diagram for the combined cycle is shown in FIG. 2. The cycle starts with the refrigerant compressed to higher pressure in the main cycle (process line 1-2). Then, the refrigerant passes through the condenser with constant pressure as represented in the process line (2-3), where it condenses to lower temperature. The process line (3-4), shown in FIG. 2, represents the heat exchanger (HX) process in the lower part of the cycle (the main air conditioning system 12) where the pressure remains constant, and the condenser temperature is further subcooled. The subcooling system 22 shown in FIG. 1 is the reason for the extra subcooling of the refrigerant. After that, the refrigerant is expanded in the expansion valve 20, having a constant enthalpy, as explained in the process line (4-5). Then, the refrigerant passes through the evaporator with constant pressure, as represented in the process line (5-1), where it evaporates to higher temperature and closes the main air conditioning system 12 cycle. From FIG. 2, it is very clear that the combined cycle has a larger process line (5-10, which indicates that it provides more cooling. For the upper part of the cycle (the subcooling system 22) shown in FIG. 1, the process line (6-7) is the compression process, during which the refrigerant is compressed to higher pressure in the dedicated mechanical subcooling cycle. The refrigerant is then condensed to a lower temperature with constant pressure, process line (7-8). After that, the refrigerant is expanded with a constant enthalpy in the expansion valve 32 to lower pressure and temperature, as indicated by the process line (8-9). The process line (9-6) represents the HX process for the dedicated mechanical subcooling cycle, where the pressure remains constant, and the enthalpy increases and closes the subcooling system 22 cycle.

The air conditioning system with solar-powered subcooling system was analyzed using the laws of thermodynamics. The basic equations for the main air conditioning system 12 are summarized in Table 1. The subscripts in the equations are based on the numbering shown in FIG. 1, noting that in the case of having the basic cycle alone, there will be four states only. State 4 in FIG. 1 will be ignored, and State 5 will be considered as the fourth state. Note that the set of equations was solved using an engineering equation solver software, EES (Klein and Alvarado, 2019). EES was also used to get the properties of the refrigerants and to perform the parametric studies.

The mass flow rate of R-410A in the baseline cycle is calculated from the cooling capacity as follows:

$$\dot{m}_A = \frac{\dot{Q}_{evap}}{h_1 - h_5}. \tag{1}$$

The work rate of the compressor is defined as follows:

$$\dot{W}_1 = \dot{m}_A(h_{2a} - h_1). \tag{2}$$

The coefficient of performance (COP) of the baseline cycle can then be calculated from the following equation:

$$COP_{base} = \frac{\dot{Q}_{evap}}{\dot{W}_1} \tag{3}$$

The hourly COP of the cycle is obtained using a parametric study by varying the outdoor temperature per hour during the average day for the whole year in Kuwait. The outdoor temperatures are used to represent the actual temperature in Kuwait at each specific time. The calculation details and assumptions of each state in the cycle are clearly represented in Table 1.

TABLE 1

Equations/assumptions for model of baseline cycle at each thermodynamic state

| State 1 | State 2 | State 3 | State 4 |
|---|---|---|---|
| $T_1 = T_{evap} + T_{sh}$<br>$P_1 = P$<br>$(T_{evap}, x_1 = 1)$ | $s_{2s} = s_1$<br>$P_2 = P_3$<br>$h_{2s} = h(s_{2s}, P_2)$ | $T_3 = T_{cond} - T_{sc}$<br>$P_3 = P$<br>$(T_{cond}, x_3 = 0)$ | $P_4 = P_1$<br>$h_4 = h_3$<br>$T_4 = T(h_4, P_4)$ |
| $h_1 = h(T_1, P_1)$<br>$s_1 = s(T_1, P_1)$ | $h_{2a} = h_1 + \frac{h_{2s} - h_1}{\eta_c}$<br>$s_{2a} = s(h_{2a}, P_2)$<br>$T_2 = T(h_{2a}, P_2)$ | $h_3 = h(T_3, P_3)$<br>$s_3 = s(T_3, P_3)$ | $s_4 = s(h_4, P_4)$ |

After analyzing the baseline cycle (the main air conditioning system 12, the combined cycle (the combined system 10) was studied. As mentioned earlier, the refrigerant used in the baseline cycle is R-410A, while the solar-powered cycle uses the optimum selected refrigerant, as explained later in this work. When simulating the combined cycle, State 4 for the lower baseline cycle is changed to State 5. The subcooling temperature for the combined cycle is found as follows:

$$T_{sc,2}=T_3-T_4. \tag{4}$$

The mass flow rate of refrigerant in the dedicated mechanical subcooling cycle is calculated from the following formula:

$$\dot{m}_B=\dot{m}_A\left(\frac{h_3-h_4}{h_6-h_9}\right). \tag{5}$$

Then, the work rate of the solar-powered compressor is determined as follows:

$$\dot{W}_2=\dot{m}_B(h_{7a}-h_6). \tag{6}$$

The total work rate of the combined cycle is defined as:

$$\dot{W}_{combined}=\dot{W}_1+\dot{W}_2. \tag{7}$$

The coefficient of performance of the combined cycle is then determined as follows:

$$COP_{combined}=\frac{\dot{Q}_{evap}}{\dot{W}_{combined}}. \tag{8}$$

After that, it is important to evaluate the improvement on the COP value by comparing the COP of the combined cycle with that of the baseline cycle with no subcooling as follows:

$$COP_{imp}=\frac{COP_{combined}-COP_{base}}{COP_{base}}\times 100\%. \tag{9}$$

The percentage of power saved by implementing the proposed cycle is obtained as follows:

$$\dot{W}_{saved}=\frac{\dot{W}_{base}-\dot{W}_{combined}}{\dot{W}_{base}}\times 100\%. \tag{10}$$

Finally, the effectiveness of the heat exchanger can be evaluated as follows:

$$\varepsilon=\frac{\Delta h_{HX}}{\Delta h_{HX,max}}. \tag{11}$$

The calculation details of each state in the combined solar-powered mechanical sub-cooling cycle are listed, as shown in Table 2. Note that the first three states are exactly similar to that of the conventional baseline cycle.

TABLE 2

Equations/assumptions for model of combined solar-powered mechanical subcooling cycle at each thermodynamic state

| State 4 | State 5 | State 6 | State 7 |
|---|---|---|---|
| $P_4=P_3$<br>$h_4=h(T_4, P_4)$<br>$s_4=s(T_4, P_4)$ | $P_5=P_1$<br>$h_5=h_4$<br>$T_5=T(h_5, P_5)$<br>$s_5=s(h_5, P_5)$ | $P_6=P_9$<br>$T_{sat,6}=T(P_6, x_6=0)$<br>$T_6=T_{sat,6}+T_{sh}$<br>$h_6=h(T_6, P_6)$<br>$s_6=s(T_6, P_6)$ | $s_{7s}=s_6$<br>$P_7=P_8$<br>$h_{7s}=h(s_{7s}, P_7)$<br>$h_{7a}=h_6+\frac{h_{7s}-h_6}{\eta_c}$<br>$s_{7a}=s(h_{7a}, P_7)$<br>$T_7=T(h_{7a}, P_7)$ |

| State 8 | State 9 | Heat exchanger |
|---|---|---|
| $T_8=T_{cond}-T_{sc}$<br>$P_8=P(T_{cond}, x_8=0)$<br>$h_8=h(T_8, P_8)$<br>$s_8=s(T_8, P_8)$ | $T_9=T_4-T_{pinch}$<br>$h_9=h_8$<br>$P_9=P(T_9, h_9)$<br>$s_9=s(T_9, h_9)$ | $\Delta h_{HX,max}=h_9-h(T_9, P_4)$<br>$\Delta h_{HX}=h_3-h_4$ |

The PV power is calculated from the following equation:

$$\dot{W}_{solar}=\eta_{PV}\times IT\times A\times\alpha, \tag{12}$$

where IT is the total irradiation in W/m$^2$, $\alpha$ is the surface absorptivity, A is the solar panel area in m$^2$, which will be selected based on the requirements as clearly explained below, and $\eta_{PV}$ is the efficiency of the solar panels and is calculated as follows:

$$\eta_{PV}=0.553-0.001T_p. \tag{13}$$

Applying energy balance on the solar panel yields:

$$\dot{W}_{solar}=IT\times A\times\alpha-\epsilon\times\sigma\times A\times(T_p^4-T_o^4)-h\times A\times(T_p-T_o), \tag{14}$$

where $\epsilon$ is the emissivity, $\sigma$ is the Stefan Boltzmann constant, $T_p$ is the panel temperature, and $T_o$ is the instantaneous air temperature at any time during the day in Kelvin. The solar time is found as follows:

$$ST=\text{Time}+\frac{[(L_s-L_L)(4\ \text{min/deg})+EOT]}{60\ \text{min/hr}}, \tag{15}$$

knowing that $L_L$ and $L_s$ are the longitude and standard longitude, respectively. EOT is the equation of time in minutes and is calculated as follows:

$$EOT=229.2\begin{bmatrix}0.000075+0.001868\cos(N)-0.032077\sin(N)\\-0.014615\cos(2N)-0.04089\sin(2N)\end{bmatrix}, \tag{16}$$

where N is in (degrees) and obtained as follows:

$$N=(\text{Day}-1)(360/365). \tag{17}$$

Based on the solar time, the hour angle in degrees is calculated as follows:

$$h^\circ=(ST-12(\text{hour}))\times 15(\text{deg/hr}). \tag{18}$$

Declination angle and angle of incidence in (degrees) are calculated from Equations 19 and 20, respectively:

$$\delta=23.45\sin\left[360\left(\frac{284+\text{Day}}{365}\right)\right]; \tag{19}$$

-continued $$\theta = \cos^{-1}[\sin(\delta)\sin(\phi)\cos(\beta) - \sin(\delta)\cos(\phi)\sin(\beta)\cos(\gamma) + \cos(\delta)\cos(\phi)\cos(\beta)\cos(h^\circ)\cos(\delta)\sin(\phi)\sin(\beta)\cos(\gamma)\cos(h^\circ) + \cos(\delta)\sin(\gamma)\sin(\beta)\sin(h^\circ)]. \quad (20)$$

Note that $\phi$ is the latitude and $\gamma$ is the surface azimuth angle, and it equals to the solar azimuth angle, which can be evaluated as follows:

$$\gamma = \gamma_\beta = \frac{h^\circ}{|h^\circ|}\left[\cos^{-1}\left(\frac{\cos(\theta_z)\sin(\phi) - \sin(\delta)}{\sin(\theta_z)\cos(\phi)}\right)\right]. \quad (21)$$

$\beta$ is the slope, and it is equivalent to the solar zenith angle that is calculated as follows:

$$\beta=\theta_z=\cos^{-1}[\cos(\phi)\cos(\delta)\cos(h^\circ)+\sin(\phi)\sin(\delta)]. \quad (22)$$

The equation for the total irradiation is:

$$IT = DNI\cos(\theta) + DIF\left(\frac{1+\cos(\beta)}{2}\right) + GHI\rho_g\left(\frac{1-\cos(\beta)}{2}\right), \quad (23)$$

where $\rho_g$ is the ground reflectivity, and DNI, DIF, and GHI are the normal direct, diffuse, and reflected irradiation, respectively, in W/m$^2$. The values of the last three parameters are measured at every hour for the average days for the whole year in Kuwait.

The cooling capacity for an AC unit in typical resident in Kuwait is 5 tons of refrigeration ($\dot{Q}_{evap}$=17.6 kW), where the demand varies based on the time and day of the year. The cooling demand is calculated hourly using the cooling load temperature deference (CLTD) method for a typical house in Kuwait. The outdoor temperatures ($T_H$) are the exact temperatures at specific times during the whole year in Kuwait. The indoor temperature ($T_L$) is the regular room temperature, which is 23° C. Also, it is assumed that the compressors have an isentropic efficiency of 80%. Other assumptions include negligible pressure drops across the components of the system; subcooling temperature $T_{sub}$=5° C., superheat temperature $T_{sh}$=5° C., and pinch point temperature $T_{pinch}$=5° C.; evaporator and condenser temperatures are $T_{evap}=T_L-T_{sh}-T_{pinch}$, and $T_{cond}=T_H+T_{sc}+T_{pinch}$, respectively; single-axis fixed angle solar panels at an optimum solar angle to maximize the solar production; and other variables and Kuwait weather data required for the solar power calculations are listed in Table 3.

TABLE 3

Parameters for solar power calculations

| Parameter | Value | Parameter | Value |
|---|---|---|---|
| $\alpha$ | 0.83 | $L_L$ | 312.22° |
| $\epsilon$ | 0.9 | $L_S$ | 315° |
| $\rho_g$ | 0.65 | $\sigma$ | $5.67 \times 10^{-8}$ W/m$^2$–K$^4$ |
| $\phi$ | 28.71° | | |

The main outcomes of this work are presented after solving all the previously defined equations using EES (Klein and Alvarado, 2019). Solving Equation 11 shows that a heat exchanger with an effectiveness of 0.82 is suitable for this work.

Figure 3:
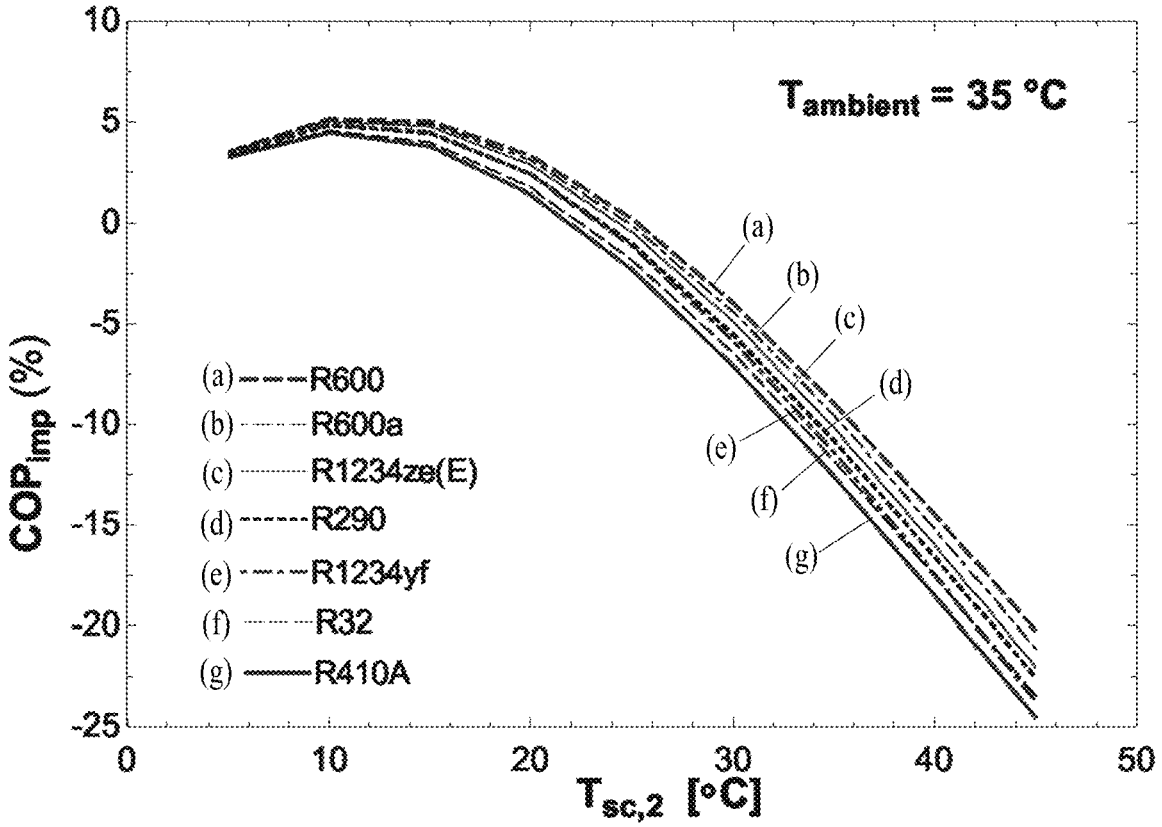
FIG. 3 is a plot of the coefficient of performance (COP %) as a function of subcooling temperature for various refrigerants in the air conditioning system of FIG. 1 at an ambient environmental temperature of 35° C.
Figure 4:
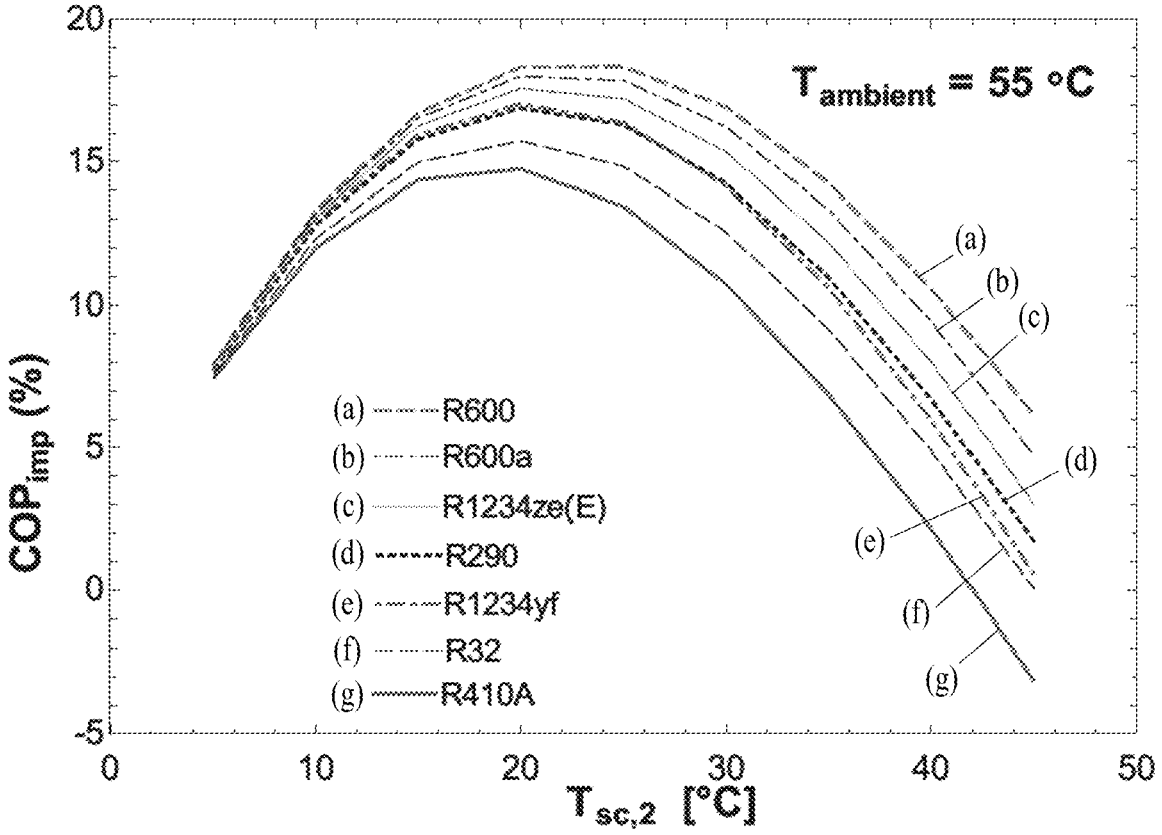
FIG. 4 is a plot of the coefficient of performance (COP %) as a function of subcooling temperature for various refrigerants in the air conditioning system of FIG. 1 at an ambient environmental temperature of 55° C.
Figure 5:
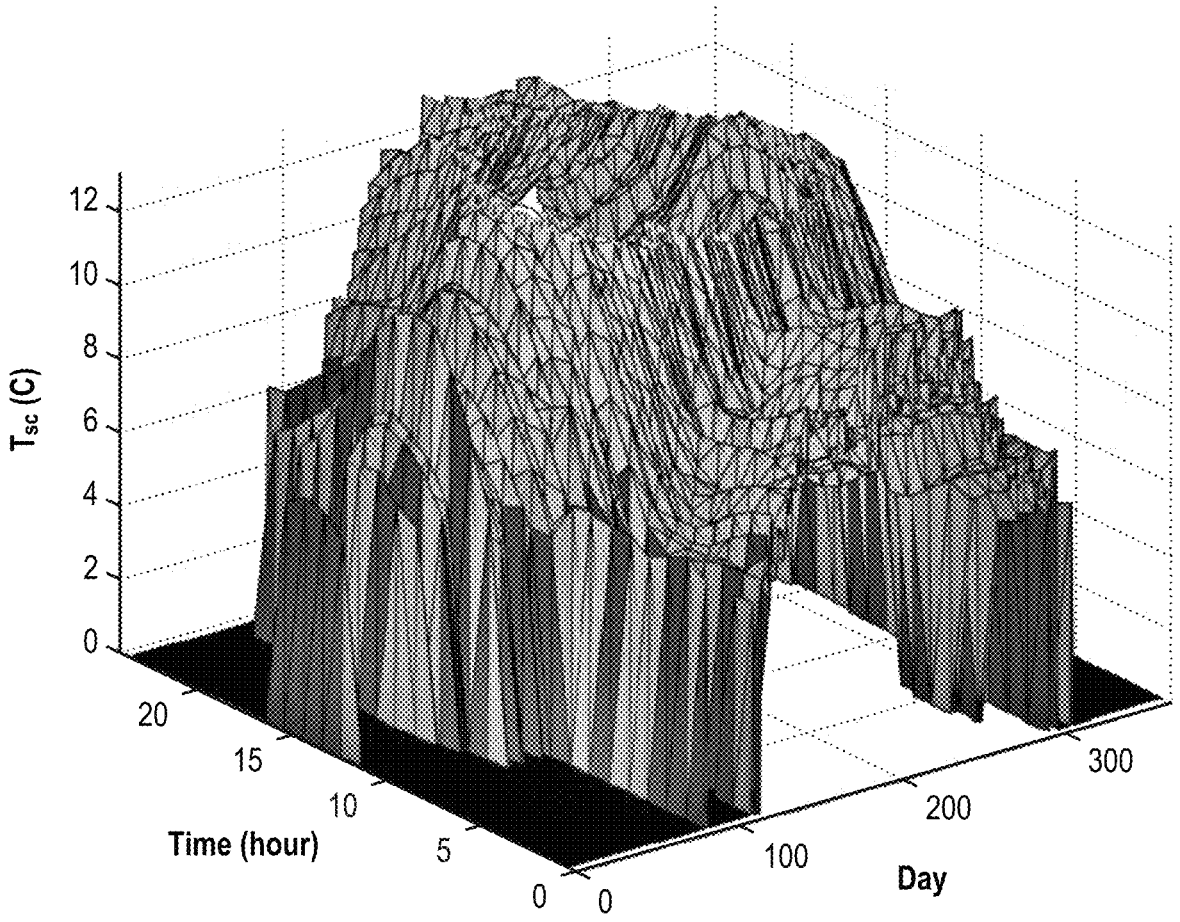
FIG. 5 is a plot of subcooling temperature as a function of day and time over the course of one year using R600 as the subcooling system refrigerant.

Different refrigerants were tested, and the optimum refrigerant, which is R-600, was chosen. The superiority of this refrigerant is shown in FIGS. 3 and 4. The improvement on the COP of the cycle shown in FIG. 1 was checked for different working refrigerants, outdoor temperatures, and subcooling temperatures. In the beginning, two outdoor temperatures were examined, which are 35° C. (representing the temperature during the moderate days in Kuwait) and 55° C. (representing the temperature during the hot days in Kuwait). The tested refrigerants are R-410A, R-123yf, R-1234ze(E), R-32, R-290, R-600, and R-600a. For both ambient temperatures and at different subcooling temperatures, R-600 showed better improvement on the COP of the cycle. In addition, R-600 is an eco-friendly refrigerant because it has zero ODP and very low GWP. After that, the cycle performance was studied during the 24 hours of the day and for all months in Kuwait. This means that the outdoor temperature is varying with time, as clarified later. FIGS. 3 and 4 show that the best subcooling temperature, which gives the maximum improvement on the COP of the cycle for the moderate days, is 12° C., while 20° C. is the optimum subcooling temperature degree for the hot days (i.e., $T_{amb}$=55° C.). As the main goal of this work is to improve the performance of the refrigeration cycle during the extremely hot days in Kuwait, the second case is selected to be studied and analyzed, as shown in FIG. 5.

Figure 6:
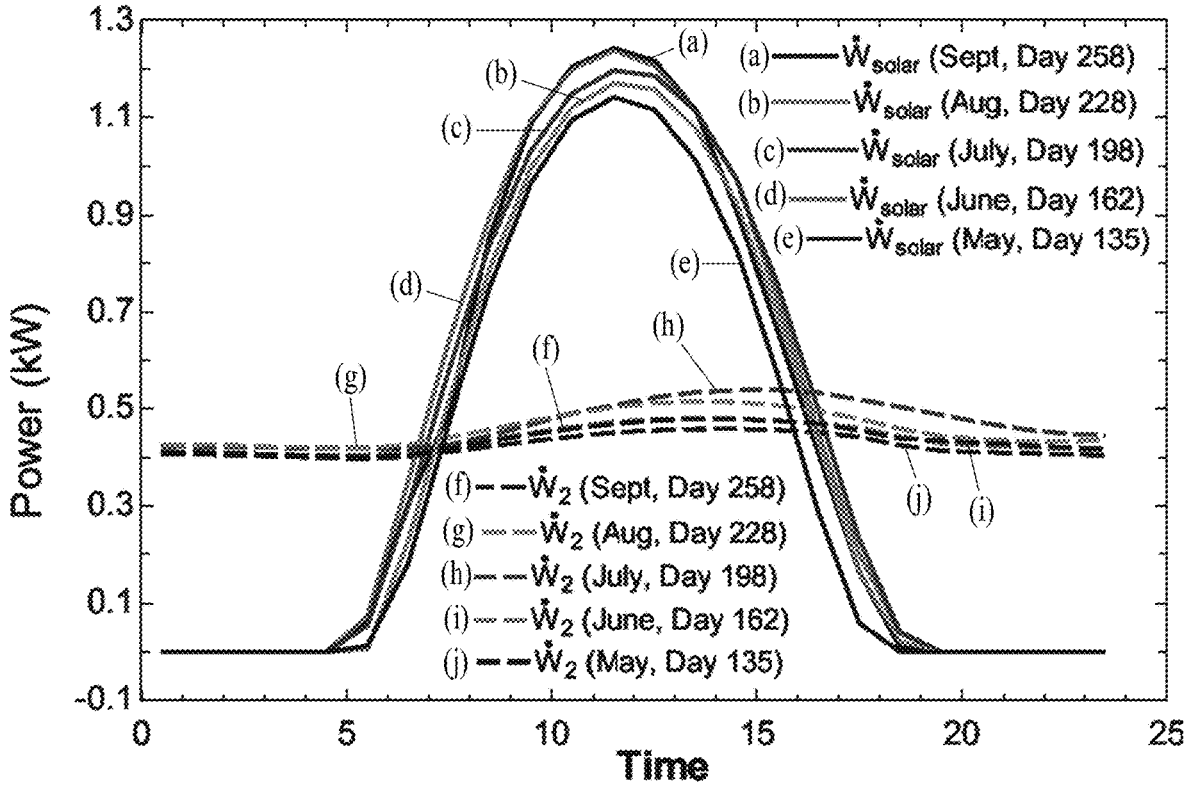
FIG. 6 is a plot of compressor power and of generated solar power as a function of time (hrs) in the air conditioning system of FIG. 1.

The relation between solar power and time of the day is presented in FIG. 6 for the average day of each hot month in Kuwait, namely, from May to September. The average day, or in other words, the typical day for those months are the day numbers 135, 162, 198, 228, and 258, respectively. As it can be seen from FIG. 6, the maximum solar power is produced in the middle of the day (i.e., time=12 hrs). The minimum solar power is produced during the month of May, while the maximum solar power is produced in the month of September. This is because the total irradiation produced at this time during the month of September is the highest. Overall, the solar power values obtained from the 1.65 m$^2$ solar panels on a hot day are close to the solar power values produced on the other hot days. The selection of this optimal area is explained below.

The solar panels used to run the system shown in FIG. 1 are battery-operated. The number of batteries required to run the refrigeration system for 24 hours per day during all months in Kuwait were determined as follows. Before determining the required number of batteries, the area of the solar panels must be selected. The selection of the area of the solar panels is based on the following steps: (1) defining the total work rate required for the dedicated mechanical solar-powered cycle; (2) the total work rate produced from the solar-powered cycle should be sufficient for the batteries to operate for 24 hours per day (to find the value of the total work rate in kWh, correlations of $\dot{W}_2$ and $\dot{W}_{solar}$ as functions of time were derived, and the areas under the curve were evaluated; this is clarified in FIG. 6, where $\dot{W}_2$ and $\dot{W}_{solar}$ are plotted versus time for the hot months, and the enclosed area between the two curves for each month is calculated); (3) each battery has a capacity power of 100 W, and hence for one day, the total power produced from each battery is 2.4 kWh. However, in this work, only 50 W is provided by each battery. This means that one battery provides a power of 1.2 kWh per day. Note that the battery power is selected based on the applicability and availability for this study.

Figure 7:
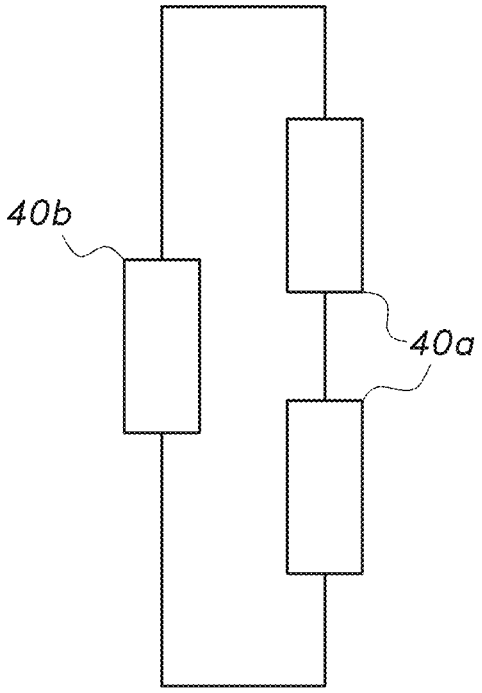
FIG. 7 is a schematic diagram of a preferred configuration of rechargeable batteries in the air conditioning system of FIG. 1.

From the above three points, the area of the solar panels was calculated and found to be equal to 1.65 m$^2$. This area should be sufficient for all hot months in Kuwait. In addition, the designed system needs three batteries to satisfy the design requirement. For the connection of the batteries, it is recommended to have two batteries 40*a* in series (shown in FIG. 7) to get a total voltage of 24 V, since each battery has a voltage of 12 V. The remaining battery 40*b* needs to be connected in parallel with the series set connection. The reason for choosing such a connection is that this connection provides a reasonable electric current that can pass through the 1.5 mm core cable that is commercially available. The connection of the batteries is represented schematically in FIG. 7.

Figure 8:
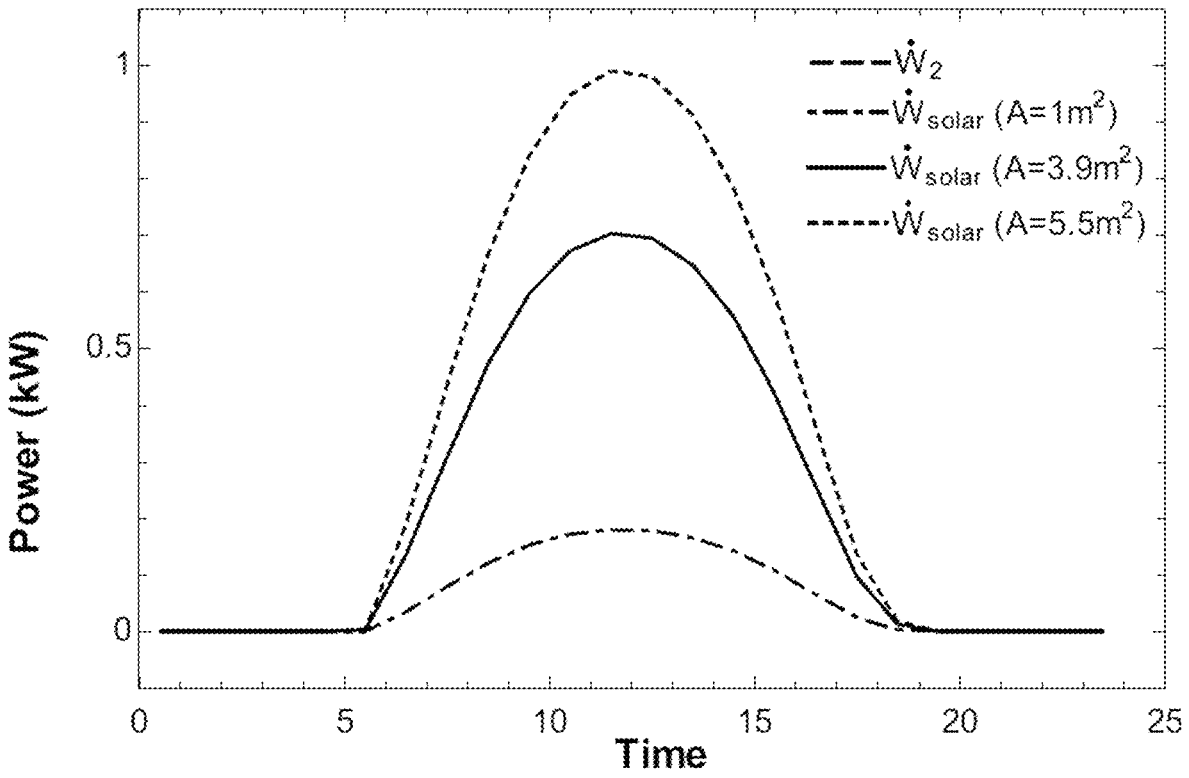
FIG. 8 is a plot of power as a function of time (hrs) for solar panels of different area.

FIG. 8 illustrates the effect of the solar panel area on the power demand during the month of August with a fixed cooling capacity of 5 tons as an example. The results show that as the area increases, the solar power consumption increases as well. This happens because solar power is directly proportional to the area of the solar panels. However, excess area results in excessive solar power that extremely exceeds the compressor's power demand, which means that a waste of energy occurs. Also, if the area results in a power that is less than the compressor power, the system will not be able to produce the required energy. Therefore, an area of 1.65 $m^2$ is sufficient for this work, yet no need to enlarge the solar panel size that might also increase the cost.

Figure 9:
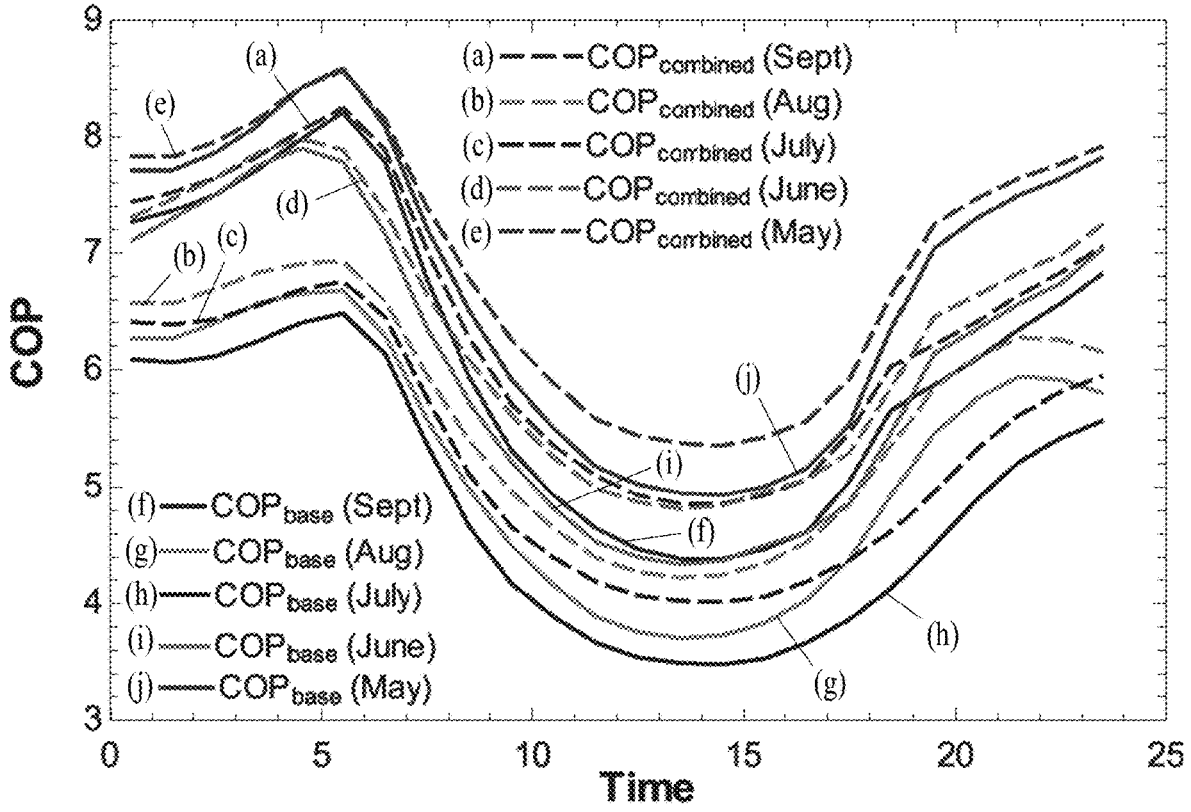
FIG. 9 is a plot of baseline COP and of combined COP as a function of time (hrs) in the air conditioning system of FIG. 1.
Figure 10:
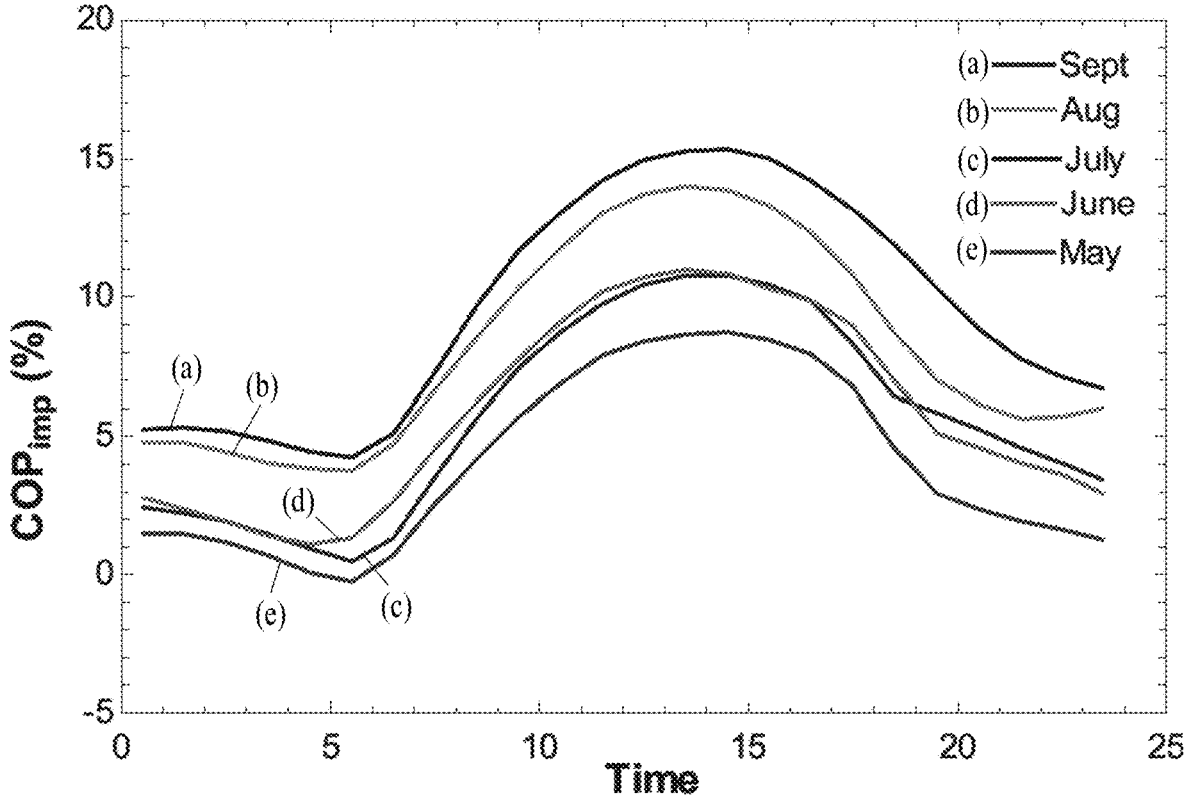
FIG. 10 is a plot of coefficient of performance (COP %) as a function of time (hrs) using the subcooling provided in the air conditioning system of FIG. 1.

As it desired to improve the performance of the refrigeration system during the hot days in Kuwait using solar power, the relations between time and both COP of the proposed cycle and the baseline cycle and the improvement on COP were plotted versus time for the hot months in Kuwait, as shown in FIGS. 9 and 10.

It can be noticed from FIG. 9 that the combined system total COP is greater than the baseline COP during the 24 hours of each typical day of the hot months in Kuwait. From midnight to sunrise, the COP increases because the outside temperature decreases during this time; which results in better system performance. Then, the COP value decreases from sunrise up to approximately time=15 hours (i.e., 3:00 p.m.) due to the gradual increase in the outside temperature during this period of the day. After that, the COP starts to increase again, as the outside temperature decreases during nighttime. It can be noticed that the maximum COP values occur in May, as it has the lowest outside temperatures among the studied months. On the other hand, the minimum COP values are associated with the month of July because July is the hottest month in Kuwait.

With respect to the improvement in system COP, FIG. 10 shows that there is a considerable improvement in the system's COP values during the 24 hours of each typical day of the hot months in Kuwait, compared to the baseline case. From midnight to sunrise and from sunset to midnight, the improvement is relatively low compared to the improvement during the daytime because there is no solar power produced during these times, which means that the combined cycle will benefit only from the extra subcooling. From sunrise up to the middle of the day, the improvement increases due to the increase in solar power values. This means that the combined cycle during the daytime can benefit from both subcooling and solar energy. From the middle of the day up to sunset, the improvement starts to decrease because of the decrement in solar energy. The maximum improvement occurs at the middle of the day because the largest solar power value is obtained at this time, as mentioned earlier. A maximum improvement of approximately 15% can be achieved during the hottest month (i.e., during month of July).

Figure 11:
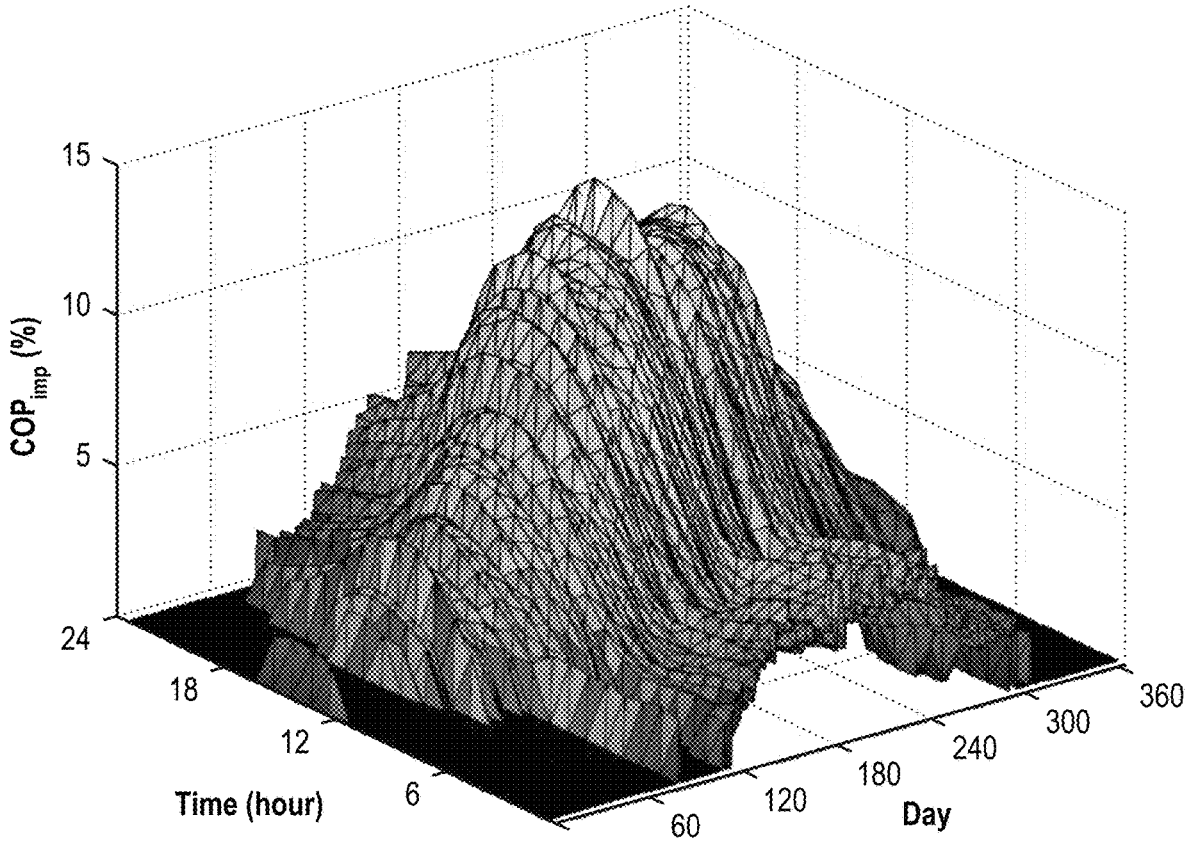
FIG. 11 is a plot of the coefficient of performance (COP %) as a function of day and time over the course of one year using R600 as the subcooling system refrigerant in the air conditioning system of FIG. 1.

With respect to the improvement in system COP, FIG. 11 shows that there is a considerable improvement in the system's COP values during the 24 hours of each day for all months in Kuwait, compared to the baseline case. A maximum improvement of approximately 15% can be achieved during the hottest month (i.e., during the month of July).

The percentage of power saved by implementing the dedicated mechanical subcooling cycle during the 24 hours of each typical day for the whole year was calculated and presented in Table 4. Table 4 shows that the proposed system can save up to approximately 11% of the utility power during the summer season in Kuwait. The maximum power saved is achieved during July and August, which are the hottest months in Kuwait. This means that the proposed system fulfilled its objective by providing additional cooling in the hottest month using solar energy. On the other hand, the minimum power saved is associated with January and December, which are the coldest months.

TABLE 4

Percentage of utility power saved-
All months in Kuwait

| | | Combined Cycle | | $\dot{W}_{saved}$ | |
|---|---|---|---|---|---|
| Month | $\dot{W}_{base}$ (kWh) | $\dot{W}_{utility}$ (kWh) | $\dot{W}_{total}$ (kWh) | Demand (%) | Total (%) |
| Jan. | 2 | 1.88 | 1.96 | 5.5 | 1.8 |
| Feb. | 37.5 | 35.0 | 36.6 | 6.8 | 2.5 |
| March | 122.1 | 113.5 | 118.9 | 7.1 | 2.6 |
| April | 362.5 | 326.6 | 347.3 | 9.9 | 4.2 |
| May | 606.6 | 512.1 | 559.8 | 15.6 | 7.7 |
| June | 727.6 | 591.6 | 656.1 | 18.7 | 9.8 |
| July | 932.5 | 746.3 | 832.5 | 20.0 | 11.0 |
| August | 804.9 | 642.1 | 717.1 | 20.2 | 11.0 |
| Sept. | 607.2 | 506.0 | 556.0 | 16.7 | 8.4 |
| Oct. | 399.3 | 352.0 | 378.0 | 11.8 | 5.3 |
| Nov. | 110.5 | 102.1 | 107.3 | 7.6 | 2.9 |
| Dec. | 11.9 | 11.2 | 11.7 | 5.8 | 1.9 |

Figure 12:
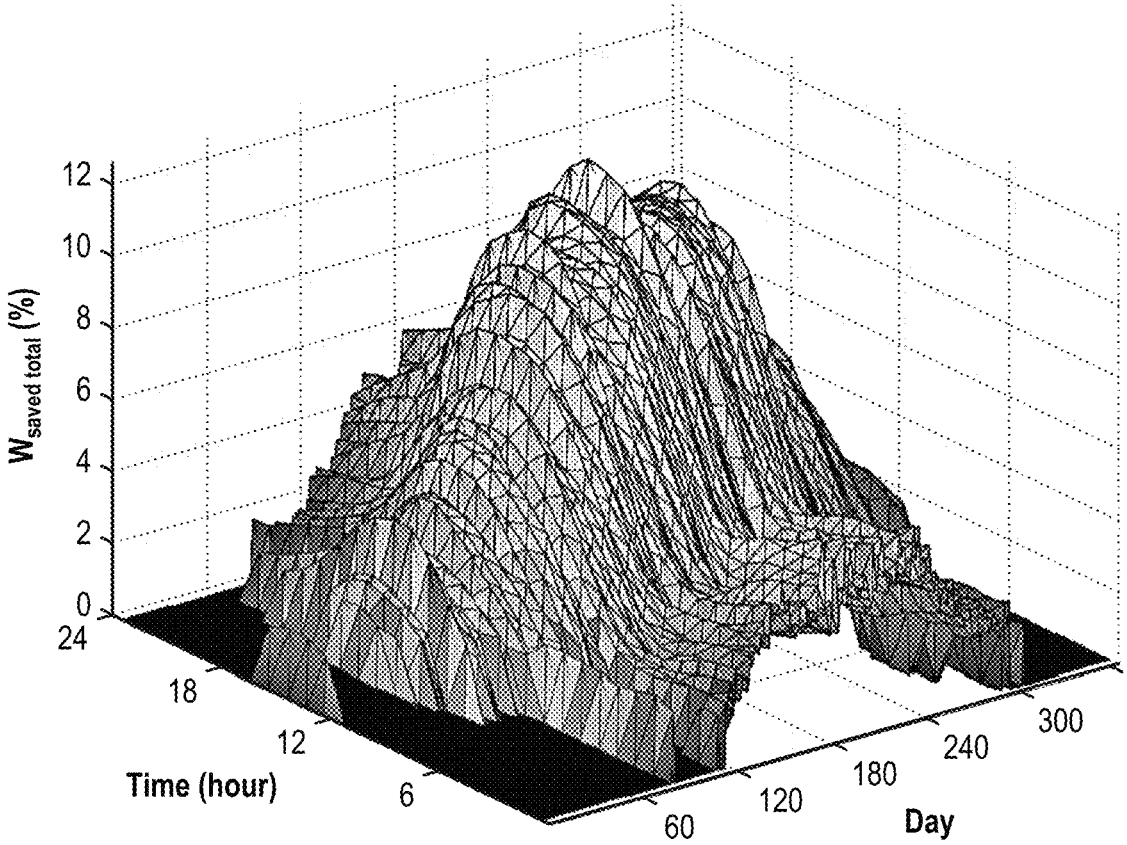
FIG. 12 is a plot of power saved (Wsaved %) as a function of day and time over the course of one year using R600 as the subcooling system refrigerant in the air conditioning system of FIG. 1.

With respect to the saved power, FIG. 12 shows that there is a considerable saving in the system's power values during the 24 hours of each day for all months in Kuwait, compared to the baseline case. A maximum saving of approximately 11% can be achieved during the hottest month (i.e., during the months of July and August).

The above system was designed based upon theoretical considerations, as described above, and should produce the results claimed. Experimental work will be conducted to design the system described herein for high ambient temperature, such as that of Kuwait's climate. Therefore, the experimental results will be used to validate the model, and then optimize the system for maximum system COP.

It is to be understood that the air conditioning system with solar-powered subcooling system is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

We claim:

1. An air conditioning system with a solar-powered subcooling system, comprising:

a main air conditioning system having:

an evaporator;

a compressor;

a condenser;

an expansion valve;

a conduit connecting the evaporator, the compressor, the condenser, and the expansion valve in that order to form a main air conditioning cycle; and a main air conditioning system refrigerant circulating through the main air conditioning conduit;

a subcooling system having:

a compressor;

a condenser;

an expansion valve;

a conduit connecting the compressor, the condenser, and the expansion valve in that order to form a subcooling cycle;

at least one rechargeable battery connected to the compressor;

a solar photovoltaic panel connected to the at least one rechargeable battery, whereby the subcooling system is powered without additional drain on a main utility system; and a subcooling system refrigerant circulating through the subcooling conduit; and a heat exchanger connecting the subcooling system to the main air conditioning system, the heat exchanger having:

a first coil disposed in the main air conditioning conduit between the main air conditioning system condenser and the main air conditioning system expansion valve; and a second coil disposed in the subcooling conduit between the subcooling system expansion valve and the subcooling system compressor so that the subcooling system further cools the main air conditioning system refrigerant, wherein said main air conditioning system refrigerant has a refrigerant capacity of 5 tons, wherein said main air conditioning system refrigerant comprises R-410A, wherein said main air conditioning system compressor is adapted for receiving electrical power from an a.c. power mains, wherein said subcooling system compressor is configured for operation on 24 volts d.c., wherein said at least one rechargeable comprises a plurality of 12V batteries connected in series, and wherein said at least one rechargeable battery comprises a first plurality of 12V batteries connected in series and a second plurality of 12V batteries connected in parallel with the first plurality to supply additional current as needed.

2. The air conditioning system according to claim 1, wherein said subcooling system refrigerant is selected from the group consisting of R-410A, R-123yf, R-1234ze(E), R-32, R-290, R-600, and R-600a.

3. The air conditioning system according to claim 1, wherein said subcooling system refrigerant comprises R-600.

4. The air conditioning system according to claim 1, wherein said at least one rechargeable battery comprises a plurality of 12V batteries connected in series.

5. The air conditioning system according to claim 1, wherein said photovoltaic panel comprises a single-axis fixed solar panel having an area of 1.65 $m^2$.

6. The air conditioning system according to claim 5, wherein said subcooling system refrigerant is selected from the group consisting of R-410A, R-123yf, R-1234ze(E), R-32, R-290, R-600, and R-600a.

7. The air conditioning system according to claim 6, wherein the air conditioning system is optimized for an environment having high ambient temperature between 35° C. and 55° C., said subcooling system refrigerant being selected to produce a subcooling temperature of 12° C. for ambient temperatures of 35° C. and a subcooling temperature of 20° C. for ambient temperatures of 55° C.

8. The air conditioning system according to claim 7, wherein said subcooling system refrigerant comprises R-600.

* * * * *